US011370583B2

(12) United States Patent
Salemi

(10) Patent No.: US 11,370,583 B2
(45) Date of Patent: Jun. 28, 2022

(54) STORAGE BOX FOR STORING AN ARTICLE

(71) Applicant: Michael E. Salemi, Long Beach, CA (US)

(72) Inventor: Michael E. Salemi, Long Beach, CA (US)

( * ) Notice: Subject to any disclaimer, the term of this patent is extended or adjusted under 35 U.S.C. 154(b) by 0 days.

(21) Appl. No.: 17/220,298

(22) Filed: Apr. 1, 2021

(65) Prior Publication Data

US 2021/0221573 A1 Jul. 22, 2021

(51) Int. Cl.
*B65D 43/22* (2006.01)
*B65D 43/16* (2006.01)

(52) U.S. Cl.
CPC ..... *B65D 43/22* (2013.01); *B65D 43/164* (2013.01)

(58) Field of Classification Search
CPC ..... B65D 43/22; B65D 2251/1058; E05B 65/006
USPC ..... 220/326, 833–835; 132/293; 361/679.58; 292/137, DIG. 11
See application file for complete search history.

(56) References Cited

U.S. PATENT DOCUMENTS 2,278,866 A * 4/1942 Dell Elba ..... A45D 33/32 362/136
2,841,814 A * 7/1958 Murphy ..... A47J 45/061 220/763
3,254,787 A * 6/1966 Braun ..... A45C 11/24 220/326
3,606,069 A * 9/1971 Harrison ..... A47B 31/00 220/23.4
3,621,115 A * 11/1971 Kolster ..... H01R 13/447 174/67
4,685,558 A * 8/1987 Filiz ..... A45C 13/007 132/294
5,135,126 A * 8/1992 Petit ..... A45C 13/1084 220/324
5,460,288 A * 10/1995 Balzeau ..... A45C 13/1084 132/293
7,703,627 B2 * 4/2010 Yuhara ..... A45D 40/222 220/326
7,789,439 B2 * 9/2010 Zhao ..... H01M 50/209 292/163
8,376,714 B2 * 2/2013 Park ..... F01P 7/162 417/18
9,844,158 B2 * 12/2017 Shi ..... H05K 5/0221

* cited by examiner

*Primary Examiner* — James N Smalley
(74) *Attorney, Agent, or Firm* — Diederiks & Whitelaw, PLC.

(57) ABSTRACT

The present invention provides a storage box (100) for storing an article, the storage box (100) having a locking assembly arranged on a portion of the body (100*b*) to facilitate an open position and closed position of the storage box (100). The locking assembly includes a biasing member (110), a latching member (120) and a button (130). The biasing member (110) is attachable to a side or front portion of the body (100*b*). The latching member (120) arranged on a portion of the biasing member (110). The latching member (120) is adapted to engage with an engaging portion of the lid (100*a*). The button (130) operably configured on the biasing member (110) such that upon pressing the button (130), the biasing member (110) biases and enable the latching member (120) to disengage with the engaging portion of the lid (100*a*) thereby opening the storage box (100).

4 Claims, 2 Drawing Sheets

STORAGE BOX FOR STORING AN ARTICLE

FIELD OF THE INVENTION

The present invention relates to a storage box More particularly, the present invention relates to a child resistant*[1] storage box for storing articles.

[1] RE: US 16,CRSC,CFR 1700.20 standard

BACKGROUND OF THE INVENTION

A wide variety of storage boxes or cases of different kind has been used for storing articles. These boxes include a bottom and a plurality of side walls defining an interior space with an upper opening for storing items. A lid is generally used to enclose the interior space by covering the upper opening of the storage box. The lid may be hinged or pivotally arranged to one of the side walls. But when it comes to a child resistant* box, these storage cases may fail to prevent the accidental openings. There are various ways to configure a storage box which can be difficult for a child to open the storage case. The prior art in this field includes numerous examples of pill bottles, medication containers and other storage cases that incorporate a wide variety of child-resistant* features.

But these storage boxes may have complex mechanism for opening and closing the lid. For example, there are storage cases having opposing side or front latches that requires simultaneous actuation to open the storage case. In some cases, the spacing between the latch mechanisms makes it difficult for a small child to open the case. These cases may even be difficult for an adult to open.

Therefore, there is a requirement of a storage box which is a child resistant[2]* box for storing articles.

[2] RE: US 16,CRSC,CFR 1700.20 standard

OBJECTS OF THE INVENTION

An object of the present invention is to provide a storage box for storing article, which is child resistant* which meets the US,CFR 1700.20 for child resistant* containers.

Another object of the present invention is to provide a storage box for storing article, which is not complex in construction.

Yet another object of the present invention is to provide a storage box for storing article, which is robust in construction and economical in design.

SUMMARY OF THE INVENTION

According to the present invention, there is provided a storage box for storing an article. The storage box is having a lid attachable to a body of the storage box. The lid and the body define an interior storage space with peripheral walls configuring the storage box. The articles are held within the interior storage space. In the present embodiment, the lid is hinged to one of the peripheral walls of the storage box enabling the lid to pivot between an open position and a closed position. A hinge or a pivot pin may be positioned on the walls to attach the lid with the body thereby releasably securing the lid with the body. In an embodiment, the lid may not be hinged or pivoted against the walls, it may be slidably connected from the side portions or latched sideways.

Further, the storage box may include a locking assembly arranged on a portion of the body to facilitate an open position and closed position of the storage box. The locking assembly may include a biasing member, a latching member, and a button. The biasing member is an elongated flat member which is attachable to a side portion of the body. In the present embodiment, the biasing member is attached to a peripheral wall of the storage box. More specifically, the biasing member is arranged opposite to the pivotal axis of the lid. In the present embodiment, the biasing member is a leaf spring with a spring force which is more than to a maximum force that can be applied by a child and meets the US 16 CPSC CFR 1700.20.

Further, the latching member may be arranged on a portion of the biasing member. The latching member can be a hook like portion capable of engaging with a portion of the lid. Specifically, the latching member is adapted to engage with an engaging portion of the lid to configure the closed position of the lid. The engaging portion may be a slot adapted to positively latch the latching member with the lid. Further, the button is operably configured on the biasing member. The button is a protruding element which protrudes away from the interior space of the storage box. The button is visibly arranged on the biasing member. In an embodiment, the button is integral to the biasing member. It may be obvious to a person skilled in the art to removably secure the button on the biasing member.

Further, in the present embodiment, the button and the latching member is arranged central to the biasing member and on a same plane. In an embodiment, the latching member is arranged beneath the biasing member. In such embodiment, the latching member is an "L" shaped member with a locking portion on a top side. The locking portion of the latching member is adapted to engage with the engaging portion of the lid. In another embodiment, the latching member is arranged above the biasing member. In such embodiment, the latching member is a protruding element with a locking portion adapted to engage with the engaging portion of the lid.

Further, when the button is pressed against the biasing member, the biasing member biases and enable the latching member to disengage with the engaging portion of the lid thereby opening the storage box. The biasing member biases back to the initial position after releasing the button. Since the spring force of the biasing member is more than to a maximum force that can be applied by a child, the lid is openable only when the spring force applied meets the US 16 CPSC,CFR 1700.20 standard which is beyond the strength capabilities of a child. An adult may exceed the required spring force to open the lid for storing articles. When the adult applies pressure on the button which is above the required spring force spring, the latching member could disengage from the engaging portion of the lid. Further in an embodiment, the locking assembly may be arranged on both the side portions or the front portions of the storage box.

BRIEF DESCRIPTION OF THE DRAWINGS

The advantages and features of the present invention will be understood better with reference to the following detailed description and claims taken in conjunction with the accompanying drawings, wherein like elements are identified with like symbols, and in which:

DETAILED DESCRIPTION OF THE INVENTION

An embodiment of this invention, illustrating its features, will now be described in detail. The words "comprising, "having, "containing," and "including," and other forms thereof, are intended to be equivalent in meaning and be open ended in that an item or items following any one of these words is not meant to be an exhaustive listing of such item or items, or meant to be limited to only the listed item or items.

The terms "first," "second," one element from another, and the terms "an" and "a" herein do not denote a limitation of quantity, but rather denote the presence of at least one of the referenced item.

The disclosed embodiments are merely exemplary of the invention, which may be embodied in various forms.

Figure 1:
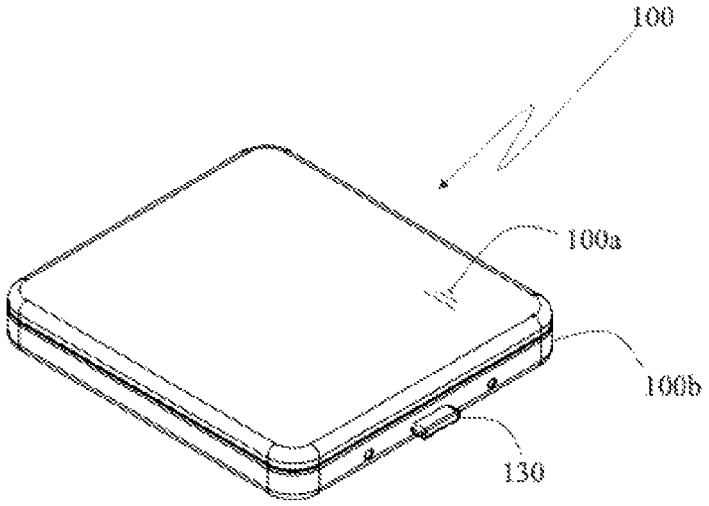
FIG. 1 illustrates a schematic representation of a first embodiment of the storage box in accordance with the present invention.
Figure 2:
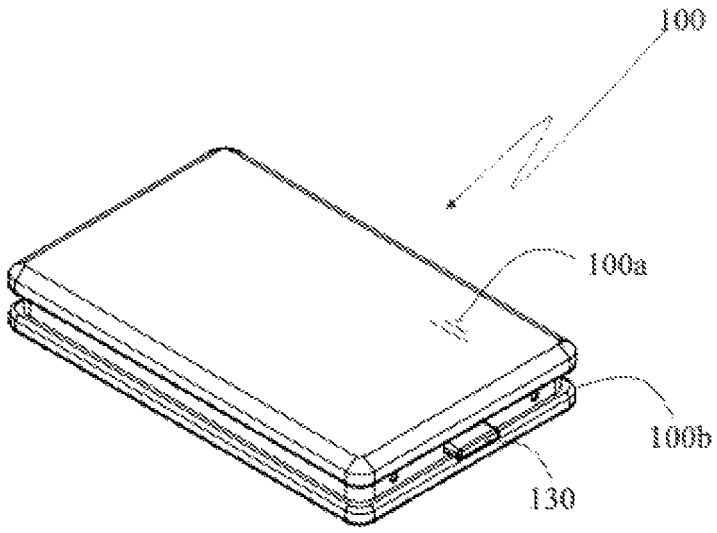
FIG. 2 illustrates a schematic representation of a second embodiment of the storage box in accordance with the present invention.

Referring now to FIGS. 1 and 2, a storage box (100) for storing an article in accordance with the present invention is illustrated. The storage box (100) is having a lid (100*a*) attachable to a body (100*b*) of the storage box (100). The lid (100*a*) and the body (100*b*) define an interior storage space with peripheral walls configuring the storage box (100). The articles are held within the interior storage space. In the present embodiment, the lid (100*a*) is hinged to one of the peripheral walls of the storage box (100) enabling the lid (100*a*) to pivot or be removed between an open position and a closed position. A hinge or a pivot pin may be positioned on the walls to attach the lid (100*a*) with the body (100*b*) thereby releasably securing the lid (100*a*) with the body (100*b*). In an embodiment, the lid (100*a*) may not be hinged or pivoted against the walls, it may be slidably connected from the side portions or latched sideways. It may be obvious to a person skilled in the art to configure the lid (100*a*) fastened with the body (100*b*) and movable between the open position and closed position by any other means.

Figure 1A:
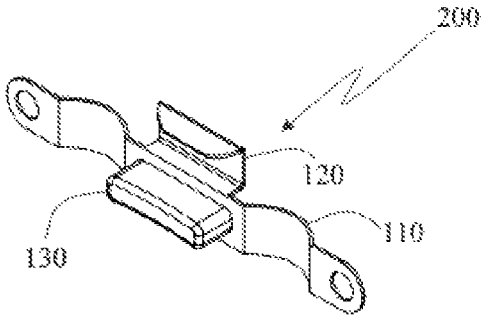
FIG. 1*a* illustrates a perspective view of a locking assembly of the storage box in accordance with FIG. 1.
Figure 2A:
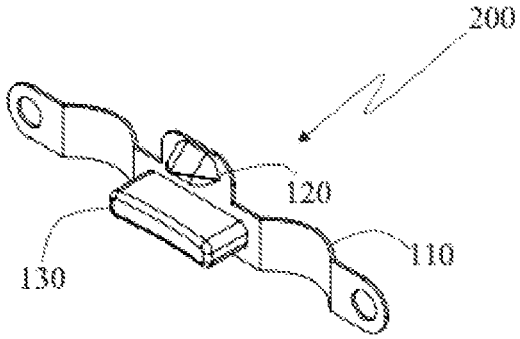
FIG. 2*a* illustrates a perspective view of a locking assembly of the storage box in accordance with FIG. 2.

Referring again to FIGS. 1 and 2, the storage box (100) includes a locking assembly (200) arranged on a portion of the body (100*b*) to facilitate an open position and closed position of the storage box (100). The locking assembly includes a biasing member (110), a latching member (120), and a button (130) as shown in FIGS. 1*a* and 2*a*. The biasing member (110) is an elongated flat member which is attachable to a side portion of the body (100*b*). In the present embodiment, the biasing member (110) is attached to a peripheral wall of the storage box (100). More specifically, the biasing member (110) is arranged opposite to the pivotal axis of the lid (100*a*). In the present embodiment, the biasing member (110) is a leaf spring with a spring force which is more than to a maximum force that can be applied by a child.

Further referring to FIGS. 1*a*, 1*b*, 2*a* and 2*b* the latching member (120) is arranged on a portion of the biasing member (110). The latching member (120) is a hook like portion capable of engaging with a portion of the lid (100*a*). Specifically, the latching member (120) is adapted to engage with an engaging portion of the lid (100*a*) to configure the closed position of the lid (100*a*). The engaging portion may be a slot adapted to positively latch the latching member (120) with the lid (100*a*). Further, the button (130) is operably configured on the biasing member (110). The button (130) is a protruding element which protrudes away from the interior space of the storage box (100). The button (130) is visibly arranged on the biasing member (110). In an embodiment, the button (130) is integral to the biasing member (110). It may be obvious to a person skilled in the art to removably secure the button (130) on the biasing member (110).

Figure 1B:
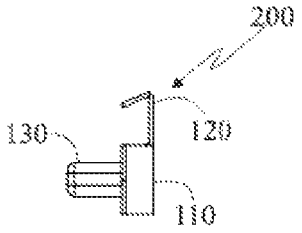
FIG. 1*b* illustrates a side view of the locking assembly in accordance with FIG. 1*a;*
Figure 2B:
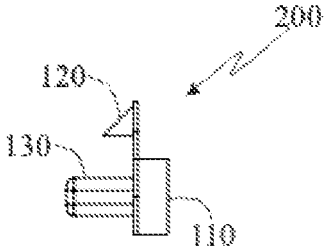
FIG. 2*b* illustrates a side view of the locking assembly in accordance with FIG. 2*a*.

Further, in the present embodiment, the button (130) and the latching member (120) is arranged central to the biasing member (110) and on a same plane. In a first embodiment as shown in FIGS. 1*a*, 1*b*, the latching member (120) is arranged beneath the biasing member (110). In such embodiment, the latching member (120) is an "L" shaped member with a locking portion on a top side. The locking portion of the latching member (120) is adapted to engage with the engaging portion of the lid (100*a*). In a second embodiment as shown in FIGS. 2*a*, 2*b*, the latching member (120) is arranged above the biasing member (110). In such embodiment, the latching member (120) is a protruding element with a locking portion adapted to engage with the engaging portion of the lid (100*a*).

Further, when the button (130) is pressed against the biasing member (110), the biasing member (110) biases and enable the latching member (120) to disengage with the engaging portion of the lid (100*a*) thereby opening the storage box (100). The biasing member (110) biases back to the initial position after releasing the button (130). Since the spring force of the biasing member (110) is more than to a maximum force that can be applied by a child, and meets the US, 16 CPSC,CFR 1700.20 standard, the lid (100*a*) is openable only when the spring force applied is beyond the strength capabilities of a child. An adult may exceed the required spring force to open the lid (100*a*) for storing articles. When the adult applies pressure on the button (130) which is above the required spring force spring, the latching member (120) could disengage from the engaging portion of the lid (100*a*).

Similarly, when the lid (100*a*) is pressed against the body (100*b*) of the storage box (100), the latching member (120) engages with the engaging portion of the lid (100*a*) to lock the lid (100*a*) against the storage box (100) thereby closing the storage box (100). Further in an embodiment, the locking assembly (200) may be arranged on both the side portions or the front portions of the storage box (100).

Therefore, the present invention has an advantage of providing a storage box for storing article, which is a child resistant[3]* storage box and can be openable only by an adult who can exceed the predefined spring force to unlatch the lid therefrom. The storage box is not complex in construction and can be easily assembled. Further, the storage box is robust in construction and economical in design.

[3] RE: US 16,CRSC,CFR 1700.20 standard

The foregoing descriptions of specific embodiments of the present invention have been presented for purposes of illustration and description. They are not intended to be exhaustive or to limit the present invention to the precise forms disclosed, and obviously many modifications and variations are possible in light of the above teaching. The embodiments were chosen and described in order to best explain the principles of the present invention and its practical application, and to thereby enable others skilled in the art to best utilize the present invention and various embodiments with various modifications as are suited to the particular use contemplated. It is understood that various omissions and substitutions of equivalents are contemplated as circumstances may suggest or render expedient, but such omissions and substitutions are intended to cover the application or implementation without departing from the scope of the claims of the present invention.

I claim:

1. A storage box (100) for storing an article, comprising:

a body (100*b*);

a lid (100*a*) attachable to the body, the lid (100*a*) and the body (100*b*) defining an interior storage space with a peripheral wall;

a locking assembly arranged on a portion of the body (100*b*) to facilitate an open position and closed position of the storage box (100), wherein the locking assembly comprises:

a biasing member (110) defining a metal leaf spring attached to the peripheral side wall and including a center planar portion, a first flat distal end portion, and a curved planar portion between the first flat distal end portion and the center planar portion configured to provide a predefined spring force which is more than a maximum force that can be applied by a child;

a latching member (120) arranged on the center planar portion of the biasing member (110), the latching member (120) being adapted to engage with an engaging portion of the lid (100*a*); wherein the biasing member biases the latching member (120) to engage with the engaging portion of the lid; and a button (130) operably configured on the biasing member (110) such that upon pressing the button (130), a counter force is generated against the biasing member (110) to enable the latching member (120) to disengage with the engaging portion of the lid (100*a*) thereby opening the storage box (100).

2. The storage box (100) as claimed in claim 1, wherein the biasing member (110) is configured with a spring force, which meets the US 16 CPSC CFR 1700.20 standard.

3. The storage box (100) as claimed in claim 1, wherein the latching member (120) engages with the engaging portion of the lid (100*a*) when closing the lid (100*a*).

4. The storage box (100) as claimed in claim 1, wherein the button (130) and the latching member (120) are arranged central to the biasing member (110) in a same plane.

* * * * *